US008502760B2

(12) United States Patent
Lin

(10) Patent No.: US 8,502,760 B2
(45) Date of Patent: Aug. 6, 2013

(54) CIRCUIT FOR CONTROLLING COLOR SEQUENTIAL LIQUID CRYSTAL DISPLAY AND METHOD FOR SCANNING THE SAME

(75) Inventor: Chia-Jung Lin, Taichung (TW)

(73) Assignee: Sitronix Technology Corp., Jhupei (JP)

( * ) Notice: Subject to any disclaimer, the term of this patent is extended or adjusted under 35 U.S.C. 154(b) by 1025 days.

(21) Appl. No.: 12/254,083

(22) Filed: Oct. 20, 2008

(65) Prior Publication Data

US 2010/0039358 A1 Feb. 18, 2010

(30) Foreign Application Priority Data

Aug. 13, 2008 (TW) ..... 97130860 A

(51) Int. Cl.
*G09G 3/36* (2006.01)

(52) U.S. Cl.
USPC ..... 345/87

(58) Field of Classification Search
USPC ..... 382/162, 254; 348/751, 761, 791; 349/8, 78, 80, 108; 345/38, 50, 51, 87, 88, 345/94, 95, 100, 102, 204, 690, 691
See application file for complete search history.

(56) References Cited

U.S. PATENT DOCUMENTS

| | | | | |
|---|---|---|---|---|
| 7,602,360 | B2 * | 10/2009 | Park | 345/89 |
| 2002/0024481 | A1 * | 2/2002 | Kawabe et al. | 345/87 |
| 2003/0034939 | A1 * | 2/2003 | Moon | 345/76 |
| 2005/0094040 | A1 * | 5/2005 | Wang et al. | 349/19 |
| 2005/0212737 | A1 * | 9/2005 | Yoshihara et al. | 345/87 |
| 2006/0125715 | A1 * | 6/2006 | Choi | 345/14 |
| 2007/0229433 | A1 * | 10/2007 | Jang | 345/96 |
| 2009/0015166 | A1 * | 1/2009 | Kwon | 315/156 |

* cited by examiner

*Primary Examiner* — Jason M Repko
*Assistant Examiner* — Shervin Nakhjavan
(74) *Attorney, Agent, or Firm* — Ming Chow; Sinorica. LLC

(57) ABSTRACT

The present invention provides a control circuit and a scanning method thereof, and can be applied to a color sequential liquid crystal display (LCD). The color sequential LCD produces a plurality of color backlights, receives a data signal, and receives a plurality of scanning signals produced by a scan driving circuit. The voltage levels of the plurality of scan signals corresponding to each of the color backlights are select levels alternately. When the voltage level of a scan signal in the plurality of scan signals is the select level, the voltage levels of the other scan signals in the plurality of scan signals are non-select levels. Because the voltage levels of the plurality of scan signals corresponding to each of the color backlights are select levels alternately to scan sequentially the same backlight, color-mixing effects on images can be reduced.

24 Claims, 3 Drawing Sheets

CIRCUIT FOR CONTROLLING COLOR SEQUENTIAL LIQUID CRYSTAL DISPLAY AND METHOD FOR SCANNING THE SAME

FIELD OF THE INVENTION

The present invention relates generally to a control circuit and a scanning method thereof, and particularly to a circuit for controlling a color sequential liquid crystal display and a method for scanning the same.

BACKGROUND OF THE INVENTION

With flourishing advancements in technologies, various information products are developed to satisfy people's different needs. In early days, the majority of displays are cathode ray tube (CRT) displays. However, because of their huge size and power consumption as well as health concern due to radiation exposure for long-term users, CRT displays are replaced gradually by liquid crystal displays (LCDs) at present. LCDs own the advantages of lightness, thinness, shortness, smallness, low radiation, and low power consumption. Thereby, they have become the main stream of the market. Currently, in order to achieve the characteristics of large size, color, thinness, lightness, and low power consumption of LCDs, high-performance light sources have to be developed.

LCDs are non-light-emitting displays. Thereby, in the environment with bad light conditions, illumination methods have to be applied. For example, LCD in a watch utilize a simple light bulb for illumination; those in automotive meters or OA terminals adopt light sources from back of the LCDs for clear displays. The thin and white light sources used this way are named backlights. LCDs according to the prior art use color filters to display the three primary colors of a pixel and hence colors can be displayed. A pixel of such LCD with color filter is composed of three subpixels corresponding to red, green, and blue color filters, respectively. Human eyes receive the red, green, and blue lights passing through the color filters and mix them to form the color of the pixel. However, color filters will affect transmittivity of light through the LCDs. Besides, they also influence the dot size of a pixel in LCDs. Thereby, the resolution of LCDs is limited by color filters.

In order to improve resolution and transmittivity problems described above, color sequential LCDs are developed. Color sequential LCDs according to the prior art display sequentially the three primary colors of a pixel to form color. In this color sequential LCD, each pixel uses three light sources to emit red, green, and blue lights, respectively, as the backlight. In a frame time, the pixel displays three data sequentially corresponding to lighting red, green, and blue lights, respectively. By taking advantage of the visual staying phenomenon of human eyes, people can identify the color of the pixel. In comparison with LCDs with color filters, color sequential LCDs do not need to use color filters and thus the dot size of a pixel in the latter LCDs is smaller than that in the former LCDs. Accordingly, color sequential LCDs can reduce costs and enhance resolution.

Color sequential LCDs display images according to the scan signal and data signal produced by the control circuit thereof. Besides, each pixel of such color sequential LCDs displays color images by using light sources of three primary colors emitting red, green, and blue lights in the same frame as backlights, respectively. Thereby, each scan signal has to scan each of the color backlights in a frame time. For example, if the control circuit produces two scan signals, then the two scan signals have to scan red, green, and blue backlights, respectively. The scanning method according to the prior art is that a sequential red-, green-, and blue-backlight cycle is completed in a scan signal cycle. Namely, after a scan signal scans the red, green, and blue backlights sequentially, the next scan signal continues to scan the next red-, green-, and blue-backlight cycle. However, such a scanning method will result in color mixing between two adjacent color backlights, because it scans sequentially red, green, and blue backlights. That is to say, in a single scan signal, the red backlight will mix with the linking green backlight, and the green backlight will mix with the linking blue backlight. Two color mixings will occur in each scan signal. Consequently, the number of color mixings in the scanning method according to the prior art increases as the number of scan signals increases, reducing quality of color images displayed on color sequential LCDs.

Accordingly, the present invention provides a circuit for controlling a color sequential liquid crystal display and a method for scanning the same, which can improve the color-mixing problems in a color sequential liquid crystal display according to the prior art, and can solve the problems described above.

SUMMARY

An objective of the present invention is to provide a circuit for controlling a color sequential liquid crystal display and a method for scanning the same, which control the voltage levels of a plurality of scan signals corresponding to each of the color backlights to be the select level alternately. Thereby, color-mixing problems can be avoided.

Another objective of the present invention is to provide a circuit for controlling a color sequential liquid crystal display and a method for scanning the same, which change the select level to the voltage level corresponding to another color backlight alternately when the color sequential LCD displays the next frame for compensating the color displayed in the present frame. Thereby, image quality can be improved.

The circuit for controlling a color sequential liquid crystal display and the method for scanning the same according to the present invention comprise a light-source driving circuit, a data driving circuit, and a scan driving circuit. The light-source driving circuit produces a plurality of driving signals; the data driving circuit produces a data signal; and the scan driving circuit produces a plurality of scan signals. The plurality of driving signals is used for controlling the color sequential LCD to produce a plurality of color backlights. The voltage levels of the plurality of scan signals corresponding to each of the color backlights are select levels alternately. When the voltage level of a scan signal in the plurality of scan signals is the select level, the voltage levels of the other scan signals in the plurality of scan signals are non-select levels. The color sequential LCD displays a frame according to the data signal, the plurality of scan signals, and the color backlights. In addition, when the color sequential LCD displays the next frame, the scan driving circuit will change the select level to the voltage level corresponding to another color backlight alternately for compensating the color displayed in the present frame.

DETAILED DESCRIPTION

In order to make the structure and characteristics as well as the effectiveness of the present invention to be further understood and recognized, the detailed description of the present invention is provided as follows along with preferred embodiments and accompanying figures.

Figure 1:
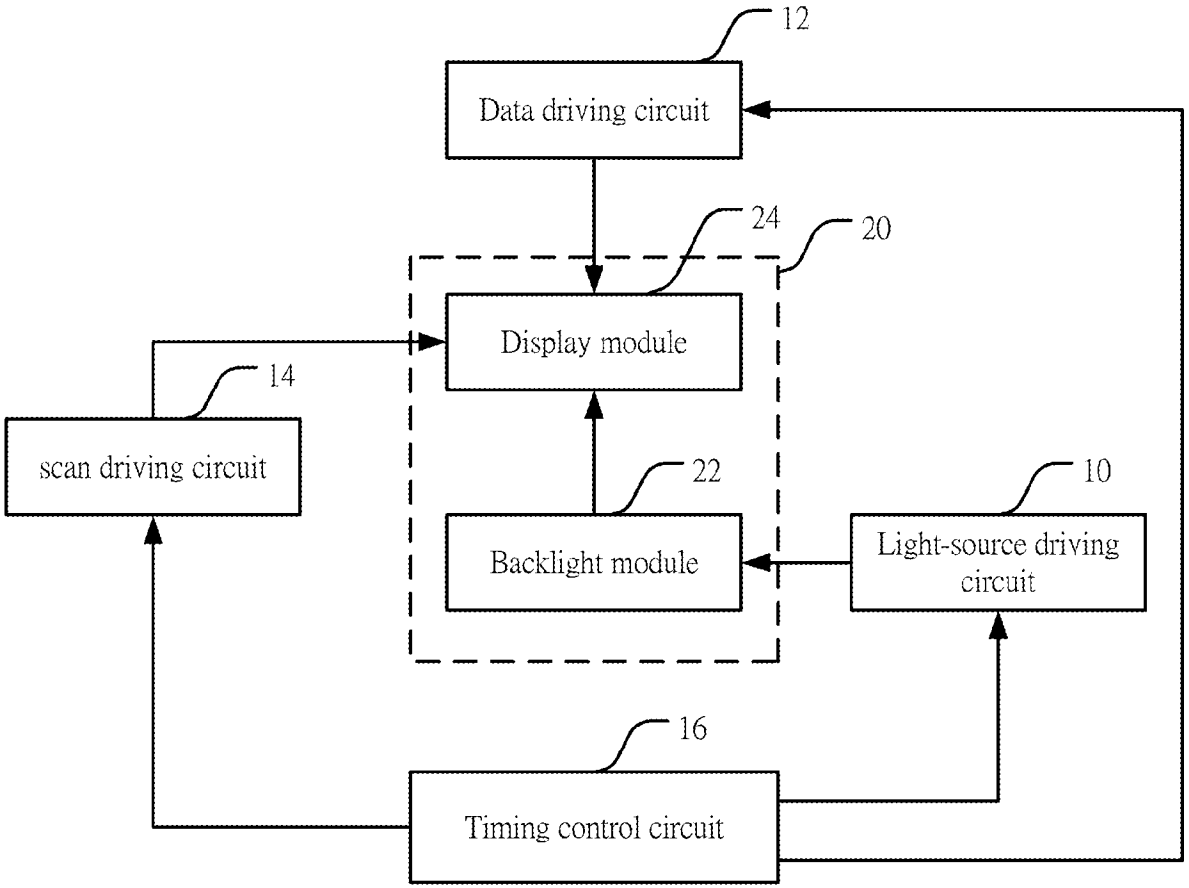
FIG. 1 shows a block diagram according to a preferred embodiment of the present invention.

FIG. 1 shows a block diagram according to a preferred embodiment of the present invention. The control circuit according to the present invention can be applied but not limited to a twisted nematic (TN) LCD or a super twisted nematic (STN) LCD. As shown in the FIG. 1, the control circuit according to the present invention comprises a light-source driving circuit 10, a data driving circuit 12, and a scan driving circuit 14. The color sequential LCD 20 includes a display panel 20, which comprises a backlight module 22 and a display module 24. The light-source driving circuit 10 is used for producing a plurality of driving signals and transmitting the plurality of driving signals to the backlight module 22 of the display panel 20 for controlling the backlight module 22 to produce sequentially backlights with different colors. The backlights include a red backlight, a green backlight, and a blue backlight.

The data driving circuit 12 is used for producing a data signal and transmitting the data signal to the display module 24 of the display panel 20. The data signal comprises a plurality of data pulses. The scan driving circuit is used for producing a plurality of scan signals and transmitting the plurality scan signals to the display module 24 of the display panel 20. The plurality of scan signals includes a plurality of scan pulses corresponding to the plurality of data pulses, respectively. The display panel 20 of the color sequential LCD produces sequentially backlights according to the pluralities of scan and data pulses as well as to the backlight module 22 and displays a frame. The display module 24 determines transmittivity, which is determined by the orientations of the liquid crystals in the display module 24, of the backlights according to the voltage difference between the voltage levels of the scan pulses and data pulses, namely, the pixel voltage, and thus displays a frame. The voltage levels of the pluralities of the scan pulses and data pulses according to the present invention change according to the colors of different frames.

Referring again to FIG. 1, the color sequential LCD according to the present invention further comprises a timing control circuit 16, which produces a timing signal according to the frame to be displayed on the color sequential LCD, and transmits the timing signal to the light-source driving circuit 10, the data driving circuit 12, and the scan driving circuit 14. The light-source driving circuit 10, the data driving circuit 12, and the scan driving circuit 14 receive the timing signal, produce the plurality of driving signals, the data signal, and the plurality of scan signals according to the timing signal, and drive the display panel 20 to display the frame. Besides, the timing control signal 16, the data driving circuit 12, and the scan driving circuit 14 can be integrated into a control chip for saving areas occupied by the control circuit and thus saving costs. Furthermore, the light-source driving circuit 10 can be integrated into the control chip as well.

Figure 2A:
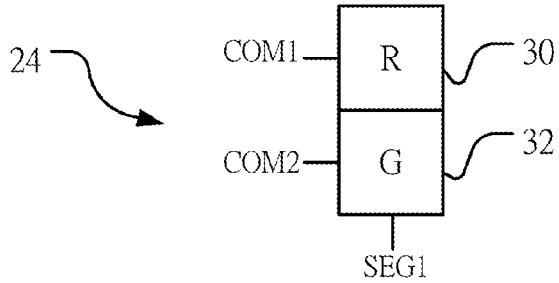
FIG. 2A shows a schematic diagram of pixels according to a preferred embodiment of the present invention.
Figure 2B:
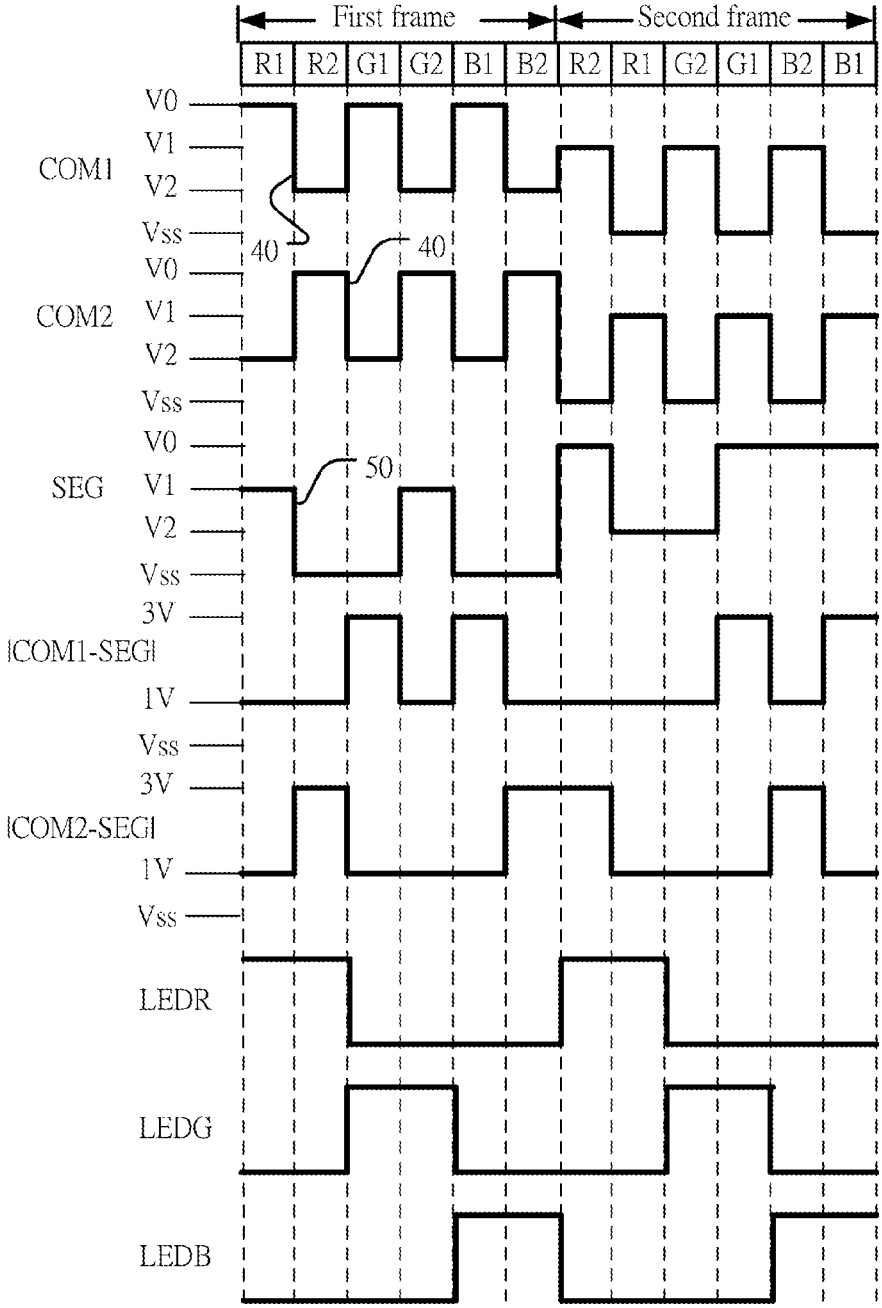
FIG. 2B shows timing diagrams according to a preferred embodiment of the present invention.

FIGS. 2A and 2B show a schematic diagram of pixels and timing diagrams according to a preferred embodiment of the present invention. The scanning method by the scan driving circuit 14 according to the present invention is described below with the accompanying figures. As shown in FIG. 2A, COM1 and COM2 are a first scanning signal and a second scanning signal produced by the scan driving circuit 14 according to the present preferred embodiment; and SEG is a data signal produced by the data driving circuit 12 according to the present preferred embodiment. The display module 244 according to the present preferred embodiment has a first pixel 30 and a second pixel 32. The display module 24 controls the first pixel 30 according to the first scanning signal COM1 and the data signal SEG; and the display module 24 controls the second pixel 32 according to the second scanning signal COM2 and the data signal SEG. As shown in FIG. 2B, the first scanning signal COM1 and the second scanning signal COM2 comprise a plurality of scan pulses 40, respectively; and the data signal SEG comprises a plurality of data pulses 50. The plurality of scan pulses 40 of the first scanning signal COM1 and the plurality of scan pulses 40 of the first scanning signal COM2 correspond to the plurality of data pulses 50 of the data signal SEG. A first voltage difference |COM1−SEG| is the pixel voltage of the first pixel 30, namely, the absolute value of the voltage difference between the voltage level of the scan pulses 40 of the first scanning signal COM1 and the voltage level of the data pulses 50 of the data signal SEG. A second voltage difference |COM2−SEG| is the pixel voltage of the second pixel 32, namely, the absolute value of the voltage difference between the voltage level of the scan pulses 40 of the second scanning signal COM2 and the voltage level of the data pulses 50 of the data signal SEG. Thereby, the display module 24 controls the first pixel 30 and the second pixel 32 according to the first voltage difference |COM1−SEG| and the second voltage difference |COM2−SEG|, respectively.

The driving signal LEDR is used in the light-source driving circuit 10 for driving the backlight module 22 to produce red backlight; the driving signal LEDG is used in the light-source driving circuit 10 for driving the backlight module 22 to produce green backlight; and the driving signal LEDB is used in the light-source driving circuit 10 for driving the backlight module 22 to produce blue backlight. Thereby, when the driving signals LEDR, LEDG, and LEGB are high, the backlight module 22 will produce red, green, and blue backlights, respectively.

The scanning method according to the present preferred embodiment is that the scan driving circuit 14 drives the first scanning signal COM1 and the second scanning signal COM2 to scan sequentially the same color backlight, but not driving the second scanning signal COM2 to scan sequentially all color backlights after the first scanning signal COM1 is driven to scan all color backlights. As shown in FIG. 2B, the scanning sequence of the scan driving circuit 14 in the first frame is R1, R2, G1, G2, B1, and B2. R1 means that the voltage level of the first scanning signal COM1 corresponds to the red backlight and is the select level (as the high level V0 shown). That is to say, the voltage level of the first scan pulse 40 of the first scanning signal COM1 is the select level, which means the first scanning signal COM1 scans the red backlight. Besides, R2 means that the voltage level of the first scanning signal COM2 corresponds to the red backlight and is the select level. That is to say, the voltage level of the second scan pulse 40 of the second scanning signal COM2 is the select level, which means the second scanning signal COM2 scans the red backlight. Thereby, the levels of the scan pulses 40 of the first and second scanning signals COM1, COM2 correspond to the red backlight, and are the select levels alternately, to scan the backlight sequentially. Likewise, when the scanning signal COM1 and the second scanning signal COM2 correspond to the green and blue backlights, the levels of the first and second scanning signals COM1, COM2 will be the select levels sequentially. In addition, when the level of the first scanning signal COM1 is the select level, the level of the second scanning signal COM2 is a non-select level (as the low level V2 shown). On the other hand, when the level of the second scanning signal COM2 is the select level, the level of the first scanning signal COM1 is the non-select level. According to the present preferred embodiment, after the first and second scanning signals COM1, COM2 produced by the scan driving circuit 14 complete scanning, the display module 24 will display a color image.

According to the present preferred embodiment, the first pixel 30 will display red R, and the second pixel will display green G. The first pixel 30 is controlled by the voltage levels of the first scanning signal COM1 and of the data signal SEG. Namely, the first pixel 30 is controlled by the first voltage difference |COM1−SEG|. On the other hand, the second pixel 32 is controlled by the voltage levels of the second scanning signal COM2 and of the data signal SEG. Namely, the second pixel 32 is controlled by the second voltage difference |COM2−SEG|. The display module 24 according to the present preferred embodiment drives the liquid crystals to rotate if the voltage difference between the scanning signal and the data signal is 3V. Then the color backlight cannot transmit through the liquid crystals. If the voltage difference between the scanning signal and the data signal is 1V, the liquid crystals will not rotate, and the color backlight can thereby transmit through the liquid crystals. That is to say, when the first voltage difference |COM1−SEG| is 3V, the first pixel 30 will not display the color backlight; and when the first voltage difference |COM1−SEG| is 1V, the first pixel 30 will display the color backlight. Likewise, when the second voltage difference |COM2−SEG| is 3V, the second pixel 32 will not display the color backlight; and when the second voltage difference |COM2−SEG| is 1V, the second pixel 32 will display the color backlight.

According to the present preferred embodiment, because the driving signal drives the backlight module 22 to produce red, green, and blue backlights sequentially within each frame time of the display module 24, and the scanning sequence of the scan driving circuit 14 in the first frame is R1, R2, G1, G2, B1, and B2, the displayed colors on the first pixel 30 according to the first voltage difference |COM1−SEG| and the corresponding color backlights are sequentially "Red+Red+None (the liquid crystals do not transmit light)+Green+None (the liquid crystals do not transmit light)+Blue". Because "Red+Green+Blue" mixes to white light, the displayed color on the first pixel 30 is "Red+White". Furthermore, because the white light will not influence the original color, the first pixel 30 will display red.

Likewise, the displayed colors on the second pixel 32 according to the second voltage difference |COM2−SEG| and the corresponding color backlights produced by the backlight module 22 are sequentially "Red+None (the liquid crystals do not transmit light)+Green+Green+Blue+None (the liquid crystals do not transmit light)". Because "Red+Green+Blue" mixes to white light, the displayed color on the second pixel 32 is "Green+White". Furthermore, because the white light will not influence the original color, the second pixel 32 will display green.

The voltage levels of the scanning signals COM1, COM2 corresponding to each of the color backlights according to the present preferred embodiment are the select levels alternately for each color backlight. That is, the scanning signals COM1, COM2 scan backlight of the same color alternately, thereby times of color mixing can be reduced during the scanning process by the scanning signals COM1, COM2. According to the present preferred embodiment, when the display module 24 displays the first frame, only two color mixings, namely, between R2 and G1, and between G2 and B1, will occur. Thus, the color image quality displayed on the display module 24 will be improved.

According to the present preferred embodiment, in order to reduce color-mixing effects caused by R2G1 and G2B1, the scan driving circuit 144 will change the scanning sequence of the scanning signals COM1 and COM2 to R2, R1, G2, G1, B2, and B1, when the display module 24 displays the second frame. That is to say, the sequence of choosing voltage levels of the scanning signals COM1, COM2 corresponding to each of the color backlights as the select level will be changed. Thereby, the influence of color mixing by the first frame can be compensated. Owing to the characteristics of liquid crystals, when the display module 24 displays different frame, the polarity of electric field applied across the liquid crystals has to be altered. This is a common technique and will not be described in more details. Accordingly, when the display module 24 displays the second frame, the select levels of the scanning signals COM1, COM2 are changed from high levels V0 to low levels Vss. Namely, when the voltage levels of the scanning pulses 40 of the scanning signals COM1, COM2 are low levels Vss, the voltage levels of the scanning signals COM1, COM2 are the select levels. Likewise, when the voltage levels of the scanning pulses 40 of the scanning signals COM1, COM2 are high levels V1, the voltage levels of the scanning signals COM1, COM2 are the non-select levels.

Figure 3A:
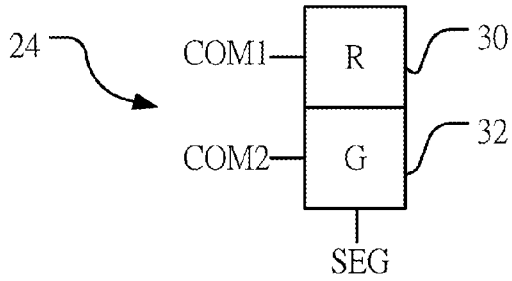
FIG. 3A shows a schematic diagram of pixels according to another preferred embodiment of the present invention.
Figure 3B:
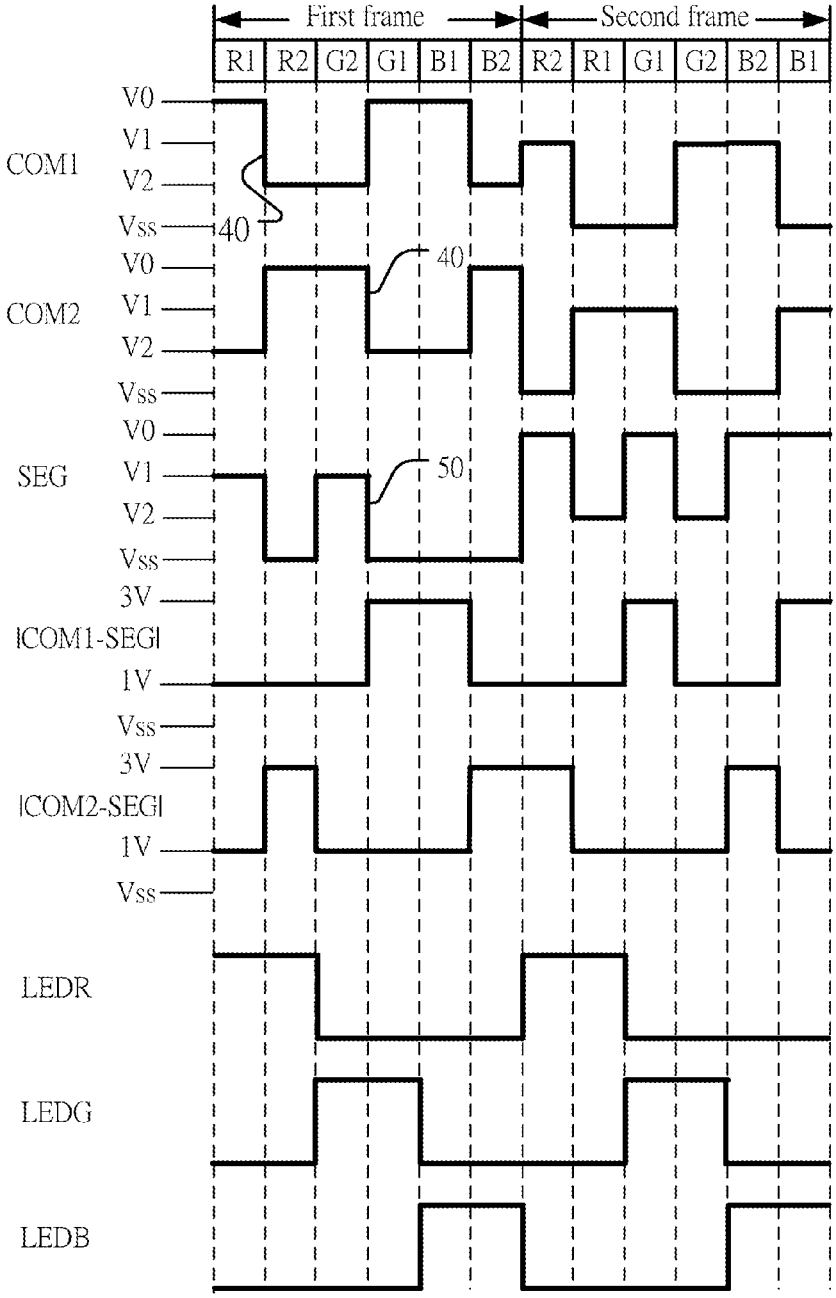
FIG. 3B shows timing diagrams according to another preferred embodiment of the present invention.

FIGS. 3A and 3B show a schematic diagram of pixels and timing diagrams according to another preferred embodiment of the present invention. FIG. 2A is the same as FIG. 3A. The difference between FIG. 2B and FIG. 3B is that the scanning sequences of FIG. 2B for the first and second frames are R1, R2, G1, G2, B1, B2, and R2, R1, G2, G1, B2, B1, respectively. On the other hand, the scanning sequences of FIG. 3B for the first and second frames are R1, R2, G2, G1, B1, B2, and R2, R1, G1, G2, B2, B1, respectively. That is to say, the sequence of choosing the voltage levels of the first and second scanning signal COM1, COM2 corresponding to green backlight as the select level alternately according to FIG. 3B is opposite to that according to FIG. 2B. In order to reduce color-mixing effects produced by R2G2 and G1B1, when the display module 24 displays the second frame, the scan driving circuit 14 will change the sequence of choosing the voltage levels of the first and second scanning signal COM1, COM2 corresponding to each of backlights as the select level alternately. Thereby, the scanning sequence becomes R2, R1, G1, G2, B2, and B1.

According to the preferred embodiment described above, two scanning signals COM1, COM2 are used for description. The scanning sequences of the scan driving circuit 144 for the first and second frames are R1, R2, G1, G2, B1, B2, and R2, R1, G2, G1, B2, B1, respectively, or R1, R2, G2, G1, B1, B2, and R2, R1, G1, G2, B2, B1, respectively. Besides, the present invention can be applied to a preferred embodiment with four scanning signals. Namely, the scan driving circuit 14 can produce a first scanning signal COM1, a second scanning signal COM2, a third scanning signal COM3, and a fourth scanning signal COM4. The scanning sequences for the first, the second, the third, and the fourth frames are: R1, R2, R3, R4, G1, G2, G3, G4, B1, B2, B3, B4, and R2, R3, R4, R1, G2, G3, G4, G1, B2, B3, B4, B1, and R3, R4, R1, R2, G3, G4, G1, G2, B3, B4, B2, B1, respectively. Alternatively, they can be R1, R2, R3, R4, G2, G3, G4, G1, B3, B4, B1, B2, and R4, R1, R2, R3, G1, G2, G3, G4, B2, B3, B4, B1, and R3, R4, R1, R2, G4, G1, G2, G3, B1, B2, B3, B4, and R2, R3, R4, R1, G3, G4, G1, G2, B4, B1, B2, B3, respectively. Accordingly, the present invention can be applied to LCDs with two or more scanning signals, but not limited to LCDs with two scanning signals only.

To sum up, the circuit for controlling a color sequential liquid crystal display and the method for scanning the same control the voltage levels of a plurality of scan signals corresponding to each of the color backlights to be the select level alternately. When the voltage level of a scan signal in the plurality of scan signals is the select level, the voltage levels of the other scan signals in the plurality of scan signals are non-select levels. In addition, when the color sequential LCD displays the next frame, the scan driving circuit will change the select level to the voltage level corresponding to another color backlight alternately for compensating the color displayed in the present frame.

Accordingly, the present invention conforms to the legal requirements owing to its novelty, non-obviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. A circuit for controlling a color sequential liquid crystal display (LCD), comprising:

a light-source driving circuit, producing a plurality of driving signals and transmitting to the color sequential LCD for controlling the color sequential LCD to produce a plurality of color backlights;

a data driving circuit, producing a data signal and transmitting to the color sequential LCD; and a scan driving circuit, producing a first scanning signal and a second scanning signal, and transmitting to the color sequential LCD, the voltage levels of the first scanning signal and the second scanning signal corresponding to each of the color backlights being select levels alternately to scan the pixels of the color sequential LCD for displaying a frame, the voltage level of the second scanning signal being a non-select level when the voltage level of the first scanning signal being the select level, and the voltage level of the first scanning signal being the non-select level when the voltage level of the second scanning signal being the select level; in the frame, the voltage level of the first scanning signal firstly being the select level to firstly scan the pixels of the color sequential LCD, and then the voltage level of the second scanning signal being the select level to scan the pixels of the color sequential LCD; in next frame, the voltage level of the second scanning signal firstly being the select level to firstly scan the pixels of the color sequential LCD, and then the voltage level of the first scanning signal being the select level to scan the pixels of the color sequential LCD;

wherein the color sequential LCD displays the frames according to the data signal, the first scanning signal, the second scanning signal, and the plurality of color backlights.

2. The circuit for controlling of claim 1, further comprising a timing control circuit producing a timing signal and transmitting to the light-source driving circuit, the data driving circuit, and the scan driving circuit for producing the plurality of driving signal, the data signal, the first scanning signal, and the second scanning signal according to the timing signal, respectively.

3. The circuit for controlling of claim 1, further comprising:

a backlight module, producing the plurality of color backlights according to the plurality of driving signals; and a display module, displaying the frame according to the data signal, the first scanning signal, the second scanning signal, and the plurality of color backlights.

4. The circuit for controlling of claim 1, wherein the plurality of color backlights includes a red backlight, a green backlight, and a blue backlight.

5. The circuit for controlling of claim 1, wherein the first scanning signal and the second scanning signal have a plurality of scan pulses, respectively, and the data signal has a plurality of data pulses, the plurality of scan pulses of the first scanning signal and the second scanning signal corresponding to the plurality of data pulses, respectively, and the voltage levels of the plurality of data pulses and of the scan pulses change according to the colors of different frames.

6. The circuit for controlling of claim 1, applied to a twisted nematic (TN) LCD or a super twisted nematic (STN) LCD.

7. A method for controlling a color sequential liquid crystal display (LCD), the color sequential LCD producing a plurality of color backlights and receiving a data signal, and comprising a step of:

producing a first scanning signal and a second scanning signal, and transmitting to the color sequential LCD, the voltage levels of the first scanning signal and the second scanning signal corresponding to each of the color backlights being select levels alternately to scan the pixels of the color sequential LCD for displaying a frame, the voltage level of the second scanning signal being a non-select level when the voltage level of the first scanning signal being the select level, and the voltage level of the first scanning signal being the non-select level when the voltage level of the second scanning signal being the select level; in the frame, the voltage level of the first scanning signal firstly being the select level to firstly scan the pixels of the color sequential LCD, and then the voltage level of the second scanning signal being the select level to scan the pixels of the color sequential LCD; in next frame, the voltage level of the second scanning signal firstly being the select level to firstly scan the pixels of the color sequential LCD, and then the voltage level of the first scanning signal being the select level to scan the pixels of the color sequential LCD;

wherein the color sequential LCD displays the frames according to the data signal, the first scanning signal, the second scanning signal, and the plurality of color backlights.

8. The method for controlling of claim 7, wherein the step of producing a first scanning signal and a second scanning signal further comprises a step of producing a timing signal for producing the first scanning signal and the second scanning signal according to the timing signal.

9. The method for controlling of claim 7, wherein a backlight module of the color sequential LCD produces the plurality of color backlights according to the plurality of driving signals, and the data signal, the first scanning signal, and the second signal are transmitted to a display module of the color sequential LCD, and the display module displays the frame according to the data signal, the first scanning signal, the second scanning signal, and the plurality of color backlights.

10. The method for controlling of claim 7, wherein the plurality of color backlights includes a red backlight, a green backlight, and a blue backlight.

11. The method for controlling of claim 7, wherein the first scanning signal and the second scanning signal have a plurality of scan pulses, respectively, and the data signal has a plurality of data pulses, the plurality of scan pulses of the first scanning signal and the second scanning signal corresponding to the plurality of data pulses, respectively, and the voltage levels of the plurality of data pulses and of the scan pulses change according to the colors of different frames.

12. The method for controlling of claim 7, applied to a twisted nematic (TN) LCD or a super twisted nematic (STN) LCD.

13. A circuit for controlling a color sequential liquid crystal display (LCD), comprising:

a light-source driving circuit, producing a plurality of driving signals and transmitting to the color sequential LCD for controlling the color sequential LCD to produce a plurality of color backlights;

a data driving circuit, producing a data signal and transmitting to the color sequential LCD; and a scan driving circuit, producing a plurality of scanning signals, and transmitting to the color sequential LCD, the voltage levels of the plurality of scanning signals corresponding to each of the color backlights being select levels alternately to scan the pixels of the color sequential LCD for displaying a frame, when the voltage level of one of the plurality of scanning signals being the select level, the voltage levels of the others of the plurality of scanning signals being non-select levels; in a first the frame, the voltage level of a M scanning signal of the plurality of scanning signals firstly being the select level to firstly scan the pixels of the color sequential LCD, and then the voltage level of a N scanning signal of the plurality of scanning signals being the select level to scan the pixels of the color sequential LCD; in next frame, the voltage level of the N scanning signal firstly being the select level to firstly scan the pixels of the color sequential LCD, and then the voltage level of the M scanning signal being the select level to scan the pixels of the color sequential LCD;

wherein the color sequential LCD displays the frames according to the data signal, the plurality of scanning signals, and the plurality of color backlight.

14. The circuit for controlling of claim 13, further comprising a timing control circuit producing a timing signal and transmitting to the light-source driving circuit, the data driving circuit, and the scan driving circuit for producing the plurality of driving signal, the data signal, and the plurality of scanning signals according to the timing signal, respectively.

15. The circuit for controlling of claim 13, further comprising:

a backlight module, producing the plurality of color backlights according to the plurality of driving signals; and a display module, displaying the frame according to the data signal, the plurality of scanning signals, and the plurality of color backlights.

16. The circuit for controlling of claim 13, wherein the plurality of color backlights includes a red backlight, a green backlight, and a blue backlight.

17. The circuit for controlling of claim 13, wherein the plurality of scanning signals has a plurality of scan pulses, respectively, and the data signal has a plurality of data pulses, the plurality of scan pulses of the plurality of scanning signals corresponding to the plurality of data pulses, respectively, and the voltage levels of the plurality of data pulses and of the scan pulses change according to the colors of different frames.

18. The circuit for controlling of claim 13, applied to a twisted nematic (TN) LCD or a super twisted nematic (STN) LCD.

19. A method for controlling a color sequential liquid crystal display (LCD), the color sequential LCD producing a plurality of color backlights and receiving a data signal, and comprising a step of:

producing a plurality of scanning signals, and transmitting to the color sequential LCD, the voltage levels of the plurality of scanning signals corresponding to each of the color backlights being select levels alternately to scan the pixels of the color sequential LCD for displaying a frame, when the voltage level of one of the plurality of scanning signals being the select level, the voltage levels of the others of the plurality of scanning signals being non-select levels; in the frame, the voltage level of a M scanning signal of the plurality of scanning signals firstly being the select level to firstly scan the pixels of the color sequential LCD, and then the voltage level of a N scanning signal of the plurality of scanning signals being the select level to scan the pixels of the color sequential LCD; in a next frame, the voltage level of the N scanning signal firstly being the select level to firstly scan the pixels of the color sequential LCD, and then the voltage level of the M scanning signal being the select level to scan the pixels of the color sequential LCD;

wherein the color sequential LCD displays the frames according to the data signal, the plurality of scanning signals, and the plurality of color backlights.

20. The method for controlling of claim 19, wherein the step of producing a plurality of scanning signals further comprises a step of producing a timing signal for producing the plurality of scanning signals according to the timing signal.

21. The method for controlling of claim 19, wherein a backlight module of the color sequential LCD produces the plurality of color backlights according to the plurality of driving signals, and the data signal and the plurality of scanning signals are transmitted to a display module of the color sequential LCD, and the display module displays the frame according to the data signal, the plurality of scanning signals, and the plurality of color backlights.

22. The method for controlling of claim 19, wherein the plurality of color backlights includes a red backlight, a green backlight, and a blue backlight.

23. The method for controlling of claim 19, wherein the plurality of scanning signals has a plurality of scan pulses, respectively, and the data signal has a plurality of data pulses, the plurality of scan pulses of the plurality of scanning signals corresponding to the plurality of data pulses, respectively, and the voltage levels of the plurality of data pulses and of the scan pulses change according to the colors of different frames.

24. The method for controlling of claim 19, applied to a twisted nematic (TN) LCD or a super twisted nematic (STN) LCD.

* * * * *